United States Patent [19]

Kawahara et al.

[11] Patent Number: 4,493,569

[45] Date of Patent: Jan. 15, 1985

[54] TYPE WHEEL CHANGING MECHANISM IN A PRINTER

[75] Inventors: Hiroshi Kawahara; Kazuo Nakamura, both of Nagoya, Japan

[73] Assignee: Brother Kogyo Kabushiki Kaisha, Nagoya, Japan

[21] Appl. No.: 290,301

[22] Filed: Aug. 5, 1981

[30] Foreign Application Priority Data

Aug. 11, 1980 [JP] Japan ..... 55-113603[U]

[51] Int. Cl.[3] ..... B41J 1/24

[52] U.S. Cl. ..... 400/144.2; 400/175; 400/208

[58] Field of Search ..... 400/144.2, 208, 144.3, 400/175, 171

[56] References Cited

U.S. PATENT DOCUMENTS

| | | | |
|---|---|---|---|
| 4,049,109 | 9/1977 | Plaza et al. | 400/144.2 X |
| 4,245,917 | 1/1981 | Mosciatti et al. | 400/144.2 |
| 4,310,255 | 1/1982 | Asano et al. | 400/171 |
| 4,315,694 | 2/1982 | Habich et al. | 400/208 X |
| 4,324,496 | 4/1982 | Link | 400/144.2 |

FOREIGN PATENT DOCUMENTS

| | | | |
|---|---|---|---|
| 132477 | 10/1978 | German Democratic Rep. | 400/144.2 |
| 148034 | 5/1981 | German Democratic Rep. | 400/144.2 |
| 44659 | 4/1981 | Japan | 400/144.2 |

OTHER PUBLICATIONS

Cox et al., "Semiautomatic Print Wheel Loader", *IBM Technical Disclosure Bulletin,* vol. 18, No. 10, p. 3356, Mar. 1976.

Okcuoglu et al., "Automated Printwheel Removal Mechanism", *IBM Technical Disclosure Bulletin,* vol. 22, No. 4, Sep. 1979, pp. 1538–1539.

Bleau, "Automatic Print Wheel Loader", *IBM Technical Disclosure Bulletin,* vol. 18, No. 10, Mar. 1976, pp. 3350–3351.

Springer, "Printwheel Removal and Ribbon Cartridge Lifting Mechanism", *IBM Technical Disclosure Bulletin,* vol. 23, No. 4, p. 1516, Sep. 1980.

Roberti et al., "Impact Printer with Cassette Daisy Wheel Type Font", *IBM Tech. Disc. Bull.,* vol. 22, No. 1, pp. 1–3, Jun. 1979.

*Primary Examiner*—Ernest T. Wright, Jr.

*Attorney, Agent, or Firm*—Browdy and Neimark

[57] ABSTRACT

A printing apparatus having a daisy-shaped type wheel which is equipped with a multiplicity of radially disposed type element holders each carrying at its outer end a type element. A printing head comprising the type wheel, an electric drive motor coupled to the type wheel, a print hammer and a ribbon cartridge, is pivoted, with a simple manipulation of a manual lever, from its lower, normal operating position to its upper non-operating, about 45°-from-horizontal position at which the type wheel is mountable on, or removable from, the end of a rotor shaft of the motor in an axial direction thereof, without interference with a platen, and with the ribbon which is put out of the mounting and removing path of the type wheel when a platform on which the cartridge is mounted is pivoted to its upper position together with, and by larger amount than, the printing head due to the manipulation of the manual lever. A difference in angle of pivoting movement between the printing head and the platform causes a pair of ribbon holders to move upward carrying an active portion of the ribbon supported therebetween to the upper position at which the ribbon is clear of the type wheel to be removed or mounted.

13 Claims, 7 Drawing Figures

FIG. 1
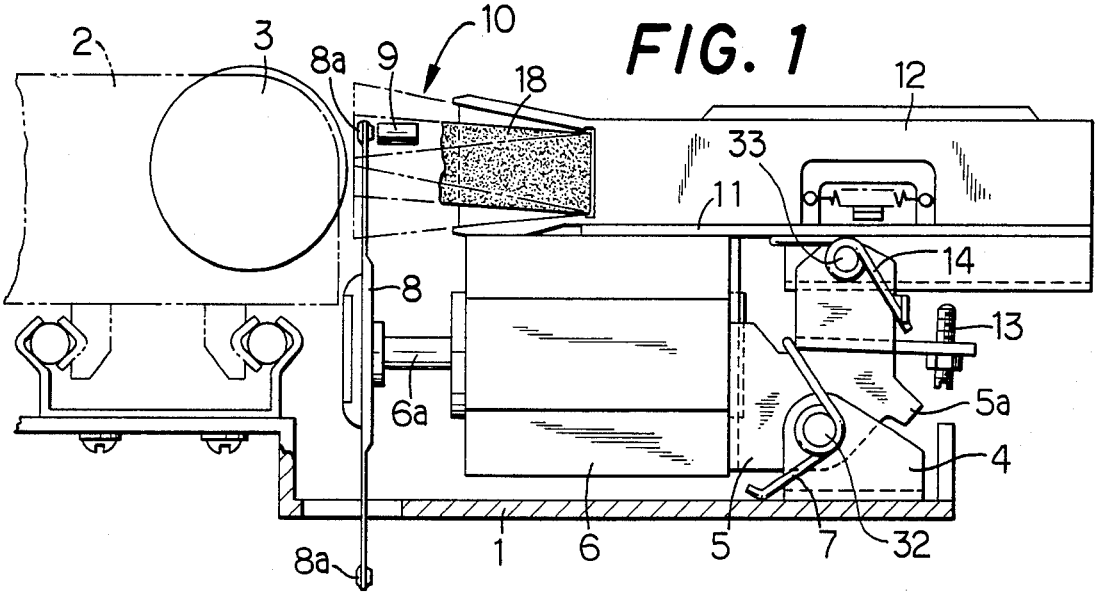
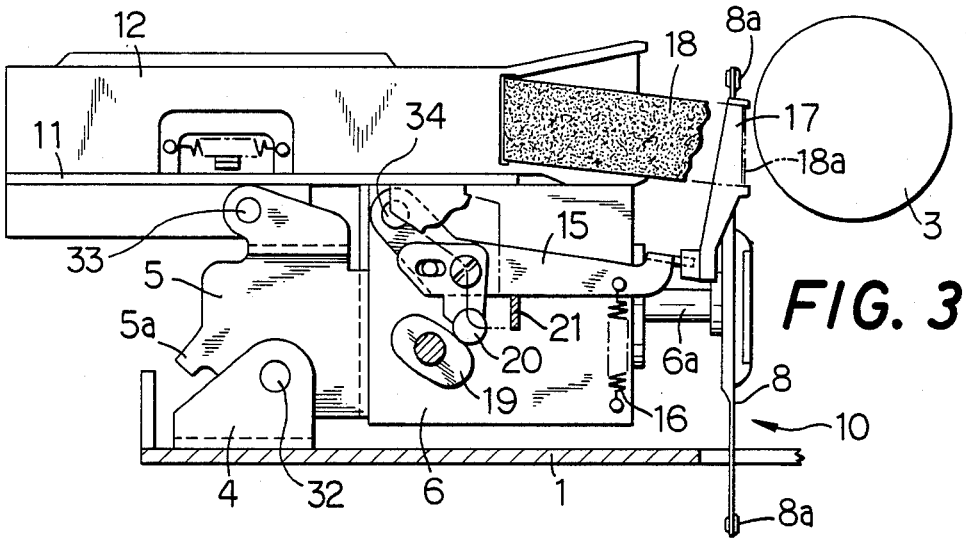
FIG. 3
FIG. 5
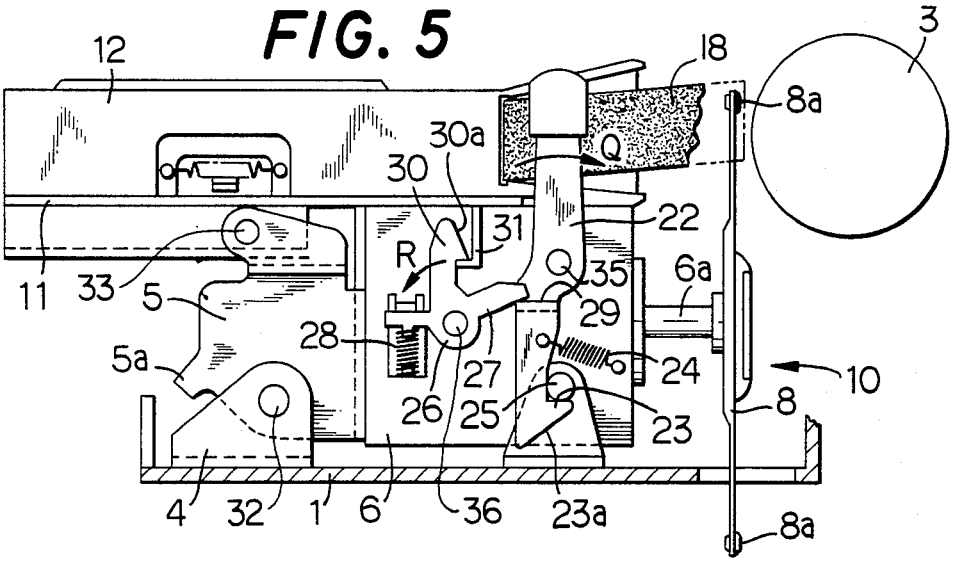

TYPE WHEEL CHANGING MECHANISM IN A PRINTER

BACKGROUND OF THE INVENTION

The present invention relates to a printing apparatus having a daisy-shaped type wheel, and more particularly to a printer of such type in which the type wheel is changeable without having to remove an inked ribbon or a ribbon cartridge.

On a printer equipped with a daisy-shaped type wheel which has a multiplicity of radially disposed type element holders each carrying at its outer end a type element, the type wheel is coupled directly with a rotor shaft of an electric drive motor and rotated continuously or intermittently in a vertical plane to select a type element into position. A selected type element which has been located at the substantially top position of the type wheel is striken by a print hammer against a sheet of paper over a platen via an inked ribbon. The inked ribbon is either held at a height of the type element to be striken, or carried to that height only when the printing action is performed from its lower non-printing position.

It is generally recognized that type elements that can be provided on one type wheel are limited in number, that is, it is impossible to provide type elements of all required characters on a single type wheel. It is also recognized that a type wheel is locally worn out or damaged during years of service. These facts suggest the necessity of changing a type wheel as needed. For the change of type wheels, the following two methods are available.

The first method is practiced by pivoting an entire printing head which carries integrally the motor, type wheel, print hammer, ribbon cartridge, etc., so that the type wheel is placed in a plane 45 degrees inclined upwardly from the horizontal plane, before the type wheel is mounted or removed in an axial direction of the rotor shaft of the drive motor. In changing a type wheel with this method, the ribbon may be an obstruction to the type wheel being changed and thus the ribbon cartridge must be removed before the type wheel is changed.

Another method is used when a printer uses a type wheel which is encased within a cartridge such that a limited number of the type elements are exposed toward the platen. In this method, the drive motor or only the rotor shaft portion is first retracted to the rear and the type wheel and its cartridge are then mounted or removed in the direction normal to the axis of the rotor shaft. Although this second method eliminates the need of removing a ribbon cartridge before mounting or removing a type wheel, it requires a cartridge for guiding the type wheel to the correct mounting position, and a type wheel cartridge guiding and supporting mechanism, preferably a highly reliable, considerably complicated mechanism that is capable of guiding the type wheel to its exact mounting position on the rotor shaft a visible access to which is not obtainable.

SUMMARY OF THE INVENTION

Accordingly, it is the object of the present invention to provide an improved printing apparatus.

Another object of the invention is to provide a printing apparatus in which a daisy-shaped type wheel is changeable with a simple manipulation.

A further object of the invention is to provide a printing apparatus which is equipped with a type wheel changeover mechanism for changing simply constructed daisy-shaped type wheels requiring no cartridge for changeover thereof.

A still further object of the invention is to provide a printing apparatus in which a daisy-shaped type wheel is changeable without interference with an inked ribbon and without damage to the wheel during mounting or removal thereof.

According to this invention there is provided a printer including a printing head having thereon an electric drive motor, a rotor shaft rotated by the electric drive motor, a daisy-shaped type wheel which is mounted on one end of, and mountable and removable axially of, the rotor shaft, and a print hammer striking a type element toward a platen selectively located at printing position on the type wheel, and characteristically improved by comprising (a) printing head supporting means for supporting the printing head pivotally between a first position thereof at which the printing head is permitted to perform a printing operation, and a second position thereof at which the type wheel is mountable and removable, (b) printing head pivoting means for pivoting the printing head from the first position to the second position in response to operation of a manual member, (c) ribbon holding means for supporting and guiding an active portion of an inked ribbon between the selectively located type element and the platen, and (d) ribbon lifting means for moving the ribbon holding means, in response to the operation of the manual member, to put the active portion of the inked ribbon out of a path taken by the type wheel when mounted or removed.

The ribbon holding means is particularly preferred to comprise a pair of vibrators pivotally supported at one ends thereof by the printing head and a ribbon holder respectively fixed to each of the other ends of the vibrators.

In a printer provided with such a ribbon holding means the ribbon lifting means may comprise an arm extending from the vibrator in opposite direction to the ribbon holder, and a fixed member disposed on a printer frame engageable with the arm to prevent the same from pivoting together with the printing head, when the printing head is pivoted toward the second position, with a result that the vibrator is pivoted relatively to the printing head in the same direction as the printing head.

In a printer wherein a ribbon cartridge accommodating an inked ribbon is mounted, it is preferable that the ribbon lifting means comprises a platform attached to the printing head pivotally in the same direction as the printing head for supporting the ribbon cartridge, means for pivoting the platform relatively to the printing head in response to the operation of the manual member, and a lift member fixed to the platform and engaged with the ribbon holding means to lift the ribbon holding means when the platform is pivoted relatively to the printing head.

The many objects and advantages of a printer made in accordance with this invention will become apparent upon consideration of the following detailed discussion when considered in association with the accompanying drawing.

BRIEF DESCRIPTION OF THE DRAWING

FIG. 1 is a sectional side view, seen from the left side, of an essential part of an embodiment of a printer in accordance with this invention;

FIG. 3 is a sectional right side view of the printer shown in FIG. 1 in which a locking mechanism of the printing head and a locking mechanism of the platform are both omitted;

FIG. 5 is a similar side view of the printer shown in FIG. 3, only difference being removal of a ribbon vibrating mechanism;

DETAILED DESCRIPTION OF THE PREFERRED EMBODIMENT

Figure 2:
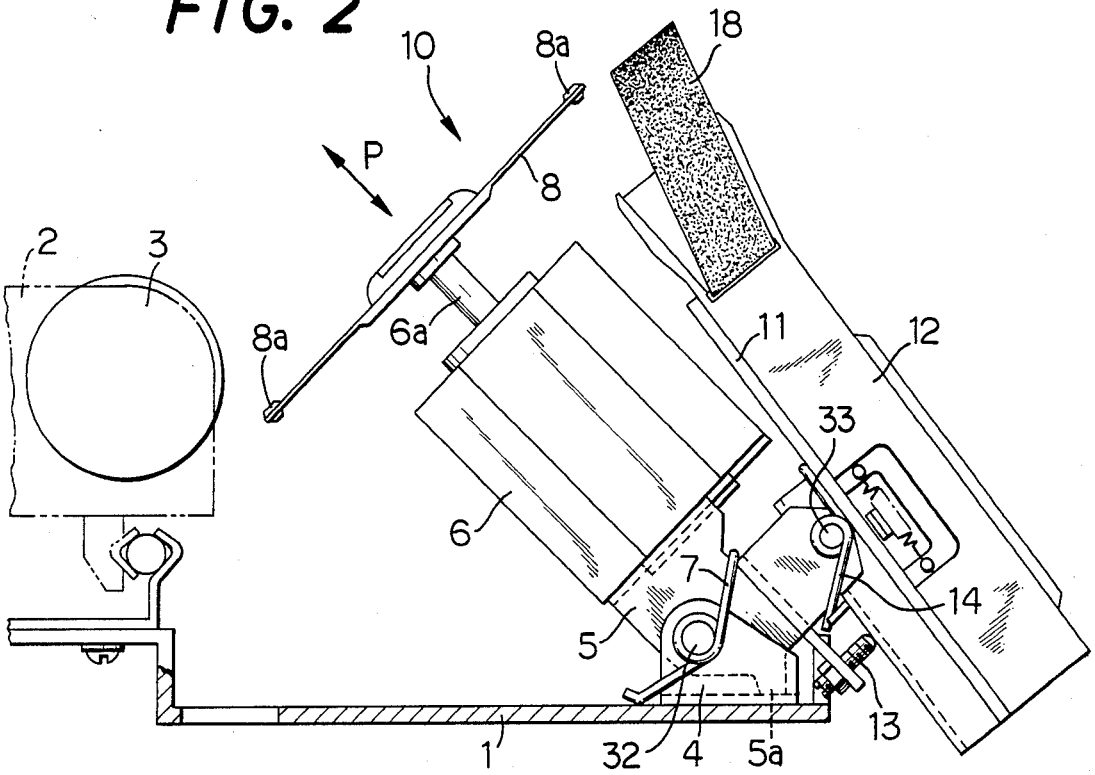
FIG. 2 is another sectional side view of the printer in FIG. 1 for showing a status wherein the printing head is being pivoted to a ready position for allowing a type wheel to be mounted or removed.

Referring to FIGS. 1 and 2, there is shown a carriage 2 of a printing apparatus, which is supported on a portion of a frame 1 of the apparatus so that it can be reciprocated along a printing line on which characters are to be printed. The carriage 2 carries thereon a platen 3 over which a sheet of paper (not shown) is placed.

On a bracket 4 of the frame 1 is rotatably supported, through a support member 5, an electric drive stepping motor 6 having a rotor shaft 6*a*. The stepping motor 6 is pivotable about a pivot pin 32, between its lower position at which the rotor shaft 6*a* is put in a horizontal plane as shown in FIG. 1, and its upper, clockwise pivoted position at which the rotor shaft 6*a* is placed in a plane about 45 degrees inclined upward from the lower horizontal position as shown in FIG. 2. The stepping motor 6 is biased by a spring 7 toward its upper, pivoted position and is thus maintained at that position, when it is pivoted thereto, by means of engagement of a stop 5*a* formed on the support member 5 with the bracket 4.

On one end of the rotor shaft 6*a*, there is mounted a daisy-shaped type wheel 8 which is easily mountable and removable in an axial direction of the shaft 6*a*. The type wheel 8 has a multiplicity of radially disposed spokes each carrying at its outer end a type element 8*a*, and is so arranged that the wheel 8 is located at its printing position facing the platen 3 when the stepping motor 6 is in the lower, horizontal position while it is upwardly clear of the platen 3 and thus mountable on, and removable from, the rotor shaft 6*a* along the axis thereof or in the direction of arrow P in FIG. 2 when the motor 6 is held at its upper, pivoted position.

While the type wheel 8 is placed at its printing position, it is rotated such an appropriate angle by the stepping motor 6 as is required to select a desired one of the circumferentially disposed type elements 8*a* into the position in alignment with a line of printing on the platen 3. The selected and aligned type element 8*a* is striken against the paper over the platen 3 by a print hammer 9 located above the stepping motor 6, whereby an appropriate character of the element 8*a* is impressed against, and printed on, the paper. Thus, it is understood that the stepping motor 6, type wheel 8 and print hammer 9 constitute a printing head 10 and that the frame 1, bracket 4 and support member 5 constitute a major part of a printing head support mechanism which enables the type wheel 8 to pivot to its upper, mounting and removing position which is clear of the periphery of the platen 3.

Above the stepping motor 6, is pivotably supported by the support member 5 a platform 11 which is pivotable about a pivot pin 33, and on which a ribbon cartridge 12 is removably mounted. The support member 5 is provided with a stop 13 which limits an amount of pivoting movement of the platform 11 and determines its upper, pivoted position such that the ribbon cartridge 12 is inclined upwardly a slight angle beyond the upper, pivoted position of the stepping motor 6, as shown in FIG. 2. The platform 11 is biased by a spring 14 in the clockwise direction as seen in FIGS. 1 and 2, that is, toward its upper, pivoted position.

Figure 4:
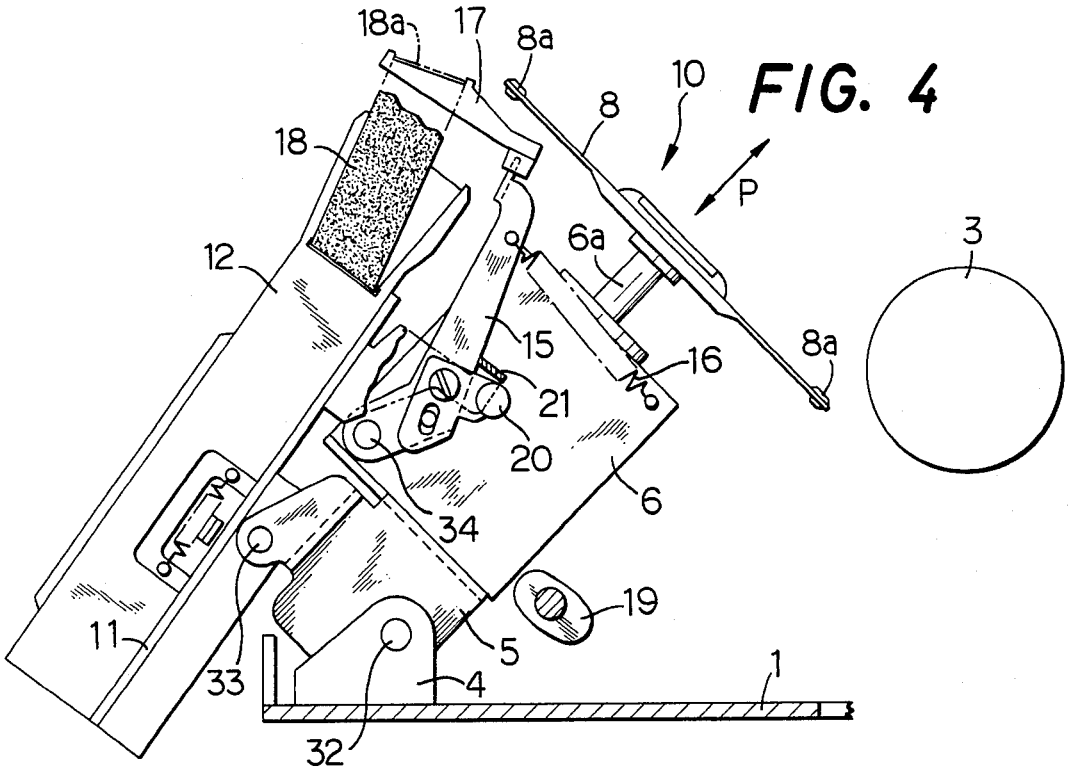
FIG. 4 is another sectional side view of the printer in FIG. 3 for showing a status wherein the printing head is being rotated to a ready position for allowing a type wheel to be mounted or removed.

There are illustrated in FIGS. 3 and 4 a pair of vibrators 15 (not shown in FIGS. 1 and 2) each on either side of the stepping motor 6. The vibrator 15 is pivotally supported at its one end portion by a pivot pin 34 fixed to a covering of the motor 6 and downwardly biased by a spring 16. A corresponding pair of ribbon holders 17 are fixed to the other end of the vibrators 15, which holders 17 support an active portion 18*a* of an inked ribbon 18 drawn from the ribbon cartridge 12 between the type wheel 8 and the platen 3, and guide the same therebetween in parallel to the platen surface.

Below each of the vibrators 15, are disposed a cam member 19, and a cam follower 20 which is connected to the vibrator 15 adjustably in position with respect thereto and engages the circumference of the cam member 19 with a biasing force of the spring 16. Every and each time the print hammer 9 takes a striking action, the cam member 19 is rotated a half turn and the vibrator 15 is pivoted reciprocatively between its lower and upper positions. With this pivoting movements of the vibrators 15, the ribbon holders 17 are lifted and lowered whereby the active portion 18*a* of the inked ribbon 18 supported by the holders 17 is lifted from its lower non-printing position up to its upper printing position between the selected type element 8*a* and the platen surface, and subsequently returned down to its non-printing position. Thus, it is noted that a ribbon holding and guiding mechanism is constituted substantially by the combination of the vibrators 15 and the ribbon holders 17.

A pair of lift members 21 are fixedly disposed on the bottom surface of the platform 11, each on either side thereof. When the stepping motor 6 and the platform 11 are pivoted counterclockwise (as seen in FIGS. 3 and 4) from the lower position shown in FIG. 3 up to their respective upper, pivoted positions shown in FIG. 4, the difference in angle of pivoting up to the upper, pivoted position between the motor 6 and the platform 11 will cause the lift members 21 to further pivot the pair of vibrators 15 counterclockwise beyond the fully-pivoted position of the motor 6 so that the active portion 18*a* of the inked ribbon 18 supported by the ribbon holders 17 is carried out of the way of the type wheel 8 being mounted or removed. Thus, this pair of lift members 21 constitute a mechanism through the aid of which the ribbon holding and guiding mechanism acts to put the active portion 18*a* of the ribbon 18 out of the path taken by the type wheel 8 when mounted or removed.

As shown in FIG. 5, a manual operating lever 22 is pivotally supported by a pivot pin 35 on one side of the stepping motor 6 and connected to the motor covering. The operating lever 22 is pivotable about its central portion when its upper end portion is manually operated, and is provided with a hooked portion 23 at its lower end. The hooked portion 23 which is biased by a spring 24, engages a pin 25 fixed to the frame 1 when the stepping motor 6 is in the lower, horizontal printing position, thereby locking the motor 6 at that lower, horizontal position.

Adjacent to the manual operating lever 22, there is provided a latching lever 26 which is pivotally supported by a pivot pin 36 fixed to the motor covering, and provided with an arm 27 which is designed to engage, through a biasing force of a spring 28, a mating engaging portion 29 formed in the operating lever 22. The latching lever 26 is also provided with a hooked portion 30 which engages a mating latching member 31 fixed to the platform 11, when the stepping motor 6 is in the locked position with the hooked portion 23 in engagement with the pin 25 and the platform 11 in the lower position at which it is parallel to the top surface of the motor 6. Thus, the engagement of the hooked portion 30 of the latching lever 26 with the latching member 31 results in locking the platform 11 at its lower position. The hooked portion 30 is designed to get out of engagement with the latching member 31 when the operating lever 22 is manually pivoted in the direction of arrow Q.

It is noted that the hooked portions 23 and 30 are formed with respective sloped contours 23*a* and 30*a* which allow for easy sliding engagement with the mating pin 25 and latching member 31, respectively, when the stepping motor 6 and the platform 11 are pivoted to their lower printing position.

While the foregoing description has referred to the constructional arrangement of one embodiment of a printing apparatus of the present invention, here is provided the description of operational aspects of the printer. FIGS. 1, 3 and 5 show that the stepping motor 6 placed in its lower, printing position is locked there with the hooked portion 23 of the operating lever 22 engaging the mating pin 25 while, on the other hand, the platform 11 placed in its horizontal position in parallel to the top surface of the stepping motor 6 is also locked there with the hooked portion 30 of the latching lever 26 engaging the latching member 31.

To remove the type wheel 8 from the rotor shaft 6*a* of the stepping motor 6 which is locked in the above position, the manual operating lever 22 is first pivoted by an operator in the direction of arrow Q in FIG. 5 and as a result, the hooked portion 23 is disengaged from the fixed pin 25 whereby the stepping motor 6 is automatically pivoted upwardly due to a biasing force of the spring 7 acting thereon until it is stopped at its upper, 45°-from-horizontal position with the stop 5*a* engaging a surface of the bracket 4 as shown in FIG. 2, while the type wheel 8 is swung from its printing position in front of the platen 3 up to its mounting and removing position clear of the platen 3.

When the operating lever 22 is operated, the latching lever 26 is pivoted in the direction of arrow R with the hooked portion 30 being disengaged from the latching member 31 and the platform 11 is automatically pivoted clockwise as seen in FIG. 1 (counterclockwise as seen in FIG. 3) due to a biasing force of the spring 14 until it is stopped at its upper position slightly above the upper position of the motor 6 with the stop 13 engaging the bottom of the platform 11 as shown in FIG. 2, whereby the lift members 21 cause the vibrators 15 to pivot counterclockwise (as seen in FIGS. 3 and 4) beyond the upper, pivoted position of the motor 6 and the ribbon holders 17 are moved counterclockwise from a position in front of the type wheel 8 while putting the active portion 18*a* of the ribbon 18 supported therebetween out of the mounting and removing path of the type wheel 8.

As described above, a simple manipulation of the operating lever 22 enables the type wheel 8 to face upwardly and clear any obstructions in front, thereby permitting the same to be easily removed or replaced with another without damage thereto or interference with the ribbon 18 or other obstructions.

It is important to note that if the type wheel 8 were removed or replaced with another at the printing position without pivoting it upward and without putting the active portion 18*a* of the ribbon 18 out of the mounting and removing path of the type wheel 8 the spokes of the wheel 8 might be damaged or broken due to interference with the ribbon 18 or other obstacles. Therefore, a type wheel on a printing apparatus of the type wherein the type wheel is changed at its printing position, has been usually enclosed with a covering material. This additional care for protection of the type wheel against damage upon removal or replacement thereof may inadvantageously increase the manufacturing cost of the type wheel.

Figure 6:
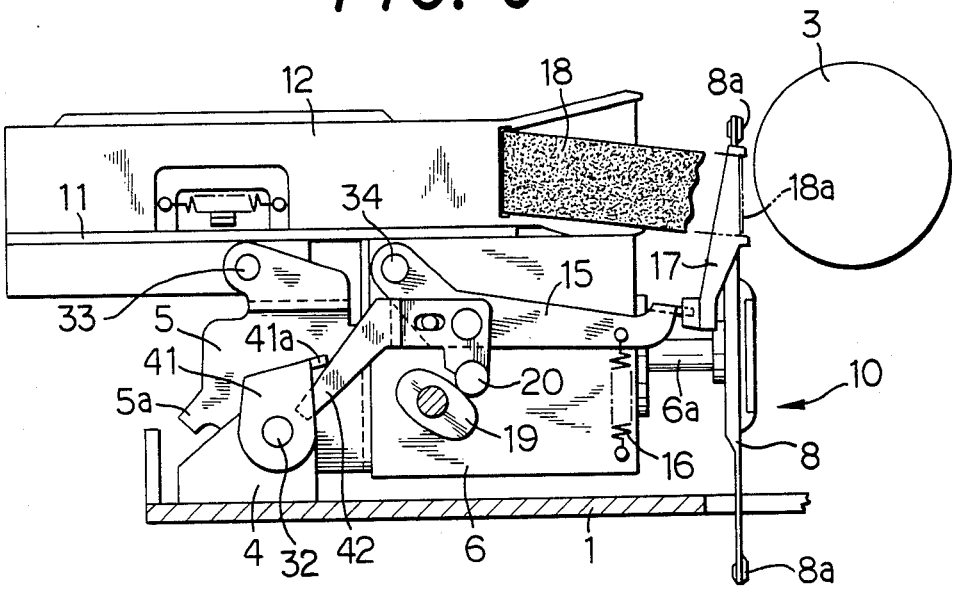
FIG. 6 is a right side sectional view of another embodiment of a printer in accordance with this invention.
Figure 7:
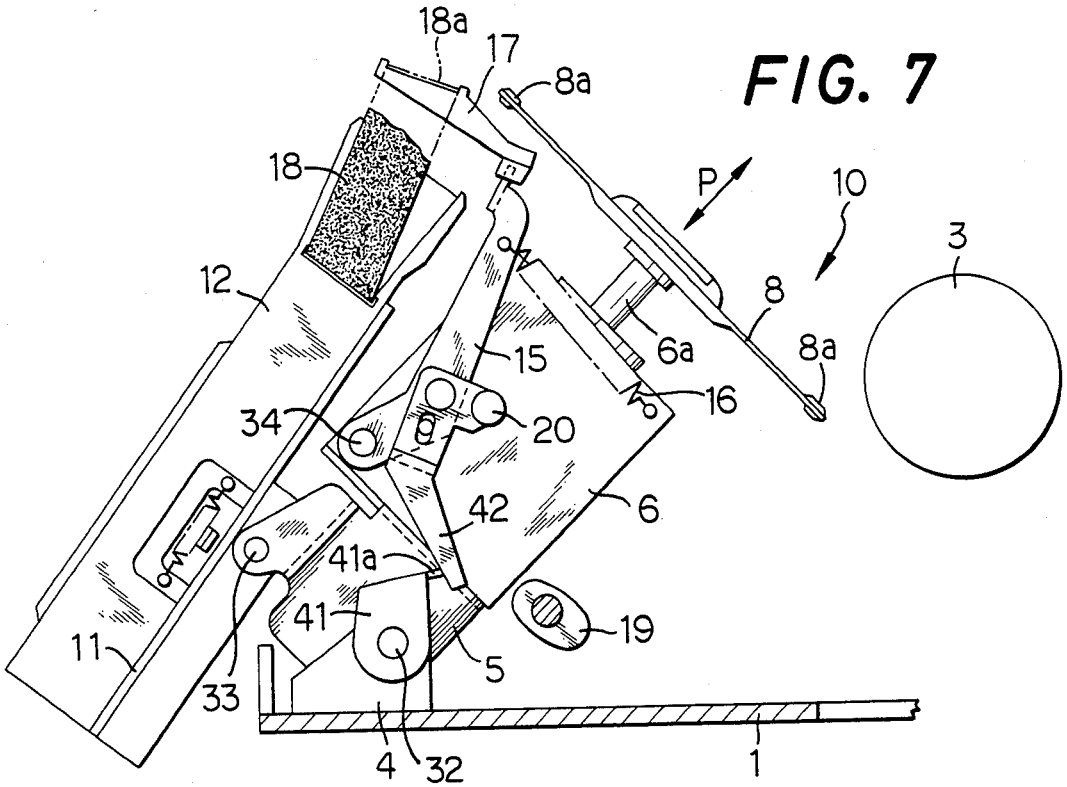
FIG. 7 is another sectional side view of the printer in FIG. 6 for showing a status wherein the printing head is being pivoted to a ready position for allowing a type wheel to be mounted or removed.

Referring now to FIGS. 6 and 7, an alternative embodiment of a printing apparatus of this invention is described below. This second embodiment uses a different mechanism from that of the first embodiment, that is, the lift members 21 of the previous embodiment are replaced with the following mechanism in the alternative embodiment.

In this embodiment, the bracket 4 supporting the stepping motor 6 is provided with a fixed member 41 which has an engaging portion 41*a*, while the cam follower 20 is formed with an integral extending arm 42 which extends under the engaging portion 41*a* of the fixed member 41. When the stepping motor 6 is pivoted to its upper position, the extending arm 42 is pivoted counterclockwise about a portion thereof engaging the engaging portion 41*a*, i.e., the vibrator 15 to which the cam follower 20 having the extending arm 42 is fixed is pivoted counterclockwise and thus the ribbon holders 17 are pivotally moved upward through a greater angle than the stepping motor 6 whereby the inked ribbon 18 between the holders 17 is carried out of the mounting and removing path of the type wheel 8.

Accordingly, the type wheel 8 in the second embodiment may be changed as easily as in the first embodiment.

What is claimed is:

1. A printer including a platen and a printing head which are movable relative to each other along a printing line on which characters are to be printed, said printing head having thereon: an electric drive motor; a rotor shaft rotated by said electric drive motor; a daisy-shaped type wheel which is mounted on one end of, and mountable and removable axially of, said rotor shaft; and a print hammer for striking toward said platen a type element selectively located at a printing position on said type wheel, wherein the improvement comprises:

printing head supporting means for supporting said printing head pivotally between a first position thereof at which said printing head is permitted to perform a printing operation, and a second position thereof at which said type wheel is mountable and removable;

printing head biasing means for biasing said printing head toward said second position thereof;

a manual member;

locking means for holding said printing head at said first position thereof against the biasing force of said printing head biasing means, said locking means being released by the operation of said manual member to permit said printing head to pivot to said second position thereof;

ribbon holding means, supported by said printing head, for supporting and guiding an active portion of an inked ribbon between said selectively located type element and said platen; and ribbon lifting means for operatively connecting said ribbon holding means to said printing head to move said ribbon holding means, in response to the pivoting movement of said printing head from said first position to said second position under the biasing force of said printing head biasing means, so as to put said active portion of said inked ribbon out of a path taken by said type wheel when mounted or removed.

2. A printer as claimed in claim 1, wherein said printing head supporting means comprises a printer frame, a bracket fixed to said printer frame, and a support member fixed to said electric drive motor and pivotally supported by said bracket.

3. A printer as claimed in claim 1, wherein said rotor shaft is upwardly inclined to place said type wheel in a position where the type wheel is clear of said platen when said printing head is at said second position.

4. A printer as claimed in claim 1, wherein said ribbon holding means comprises a pair of vibrators pivotally supported at one end thereof by said printing head and a ribbon holder respectively fixed to each of the other ends of said vibrators.

5. A printer as claimed in claim 4, wherein said printing head supporting means comprises a printer frame, and said ribbon lifting means comprises an arm extending from each of said vibrators in an opposite direction to the respective ribbon holder, and a fixed member disposed on said printer frame and engageable with said arm to prevent the arm from pivoting together with said printing head, when said printing head is pivoted toward said second position, with a result that said vibrators are pivoted relatively to said printing head in the same direction as said printing head.

6. A printer as claimed in claim 1, wherein said ribbon lifting means comprises:

a platform pivotally attached to said printing head, and being pivotable in the same direction as said printing head, for supporting a cartridge which accommodates said inked ribbon;

means for pivoting said platform relatively to said printing head in response to the operation of said manual member; and a lift member fixed to said platform and engageable with said ribbon holding means to lift said ribbon holding means when said platform is pivoted relatively to said printing head.

7. A printer as claimed in claim 6, wherein said platform pivoting means comprises:

platform biasing means for biasing said platform to pivot the platform relatively to said printing head; and a latching lever pivotably attached to said printing head, and provided with a hooked portion engageable with said platform to hold the platform at a normal position thereof against the biasing force of said platform biasing means, said latching lever being further provided with a portion which engages said manual member to disengage said hooked portion from said platform when said manual member is operated.

8. A printer including a platen and a printing head which are movable relative to each other along a printing line on which characters are to be printed, said printing head having thereon: an electric drive motor; a rotor shaft rotated by said electric drive motor; a daisy-shaped type wheel which is mounted on one end of, and mountable and removable axially of, said rotor shaft; and a print hammer striking a type element toward said platen selectively located at printing position on said type wheel, wherein the improvement comprises:

a supporting mechanism holding said printing head pivotally between a first position thereof at which said printing head is permitted to perform a printing operation, and a second position thereof at which said printing head is mountable and removable;

first biasing means for urging said printing head toward said second position thereof;

a first locking mechanism disposed between said supporting mechanism and said printing head, and locking the printing head at said first position thereof against a biasing force of said first biasing means;

a manual unlocking member connected to said first locking mechanism, unlocking said printing head from said first position, and permitting the printing head to pivot to said second position;

a ribbon cartridge accommodating an inked ribbon;

a ribbon holding member supporting and guiding, an active portion of said inked ribbon exposed outside said ribbon cartridge, between said selectively located type element and said platen;

a platform pivotally attached to said printing head pivotally in the same direction as said printing head and supporting said ribbon cartridge;

second biasing means for urging said platform in a direction away from a normal position thereof;

a second locking mechanism locking said platform at said normal position thereof against a biasing force of said second biasing means, and connected to said manual unlocking member, said platform being unlocked together with said printing head locked by said first locking mechanism when said manual unlocking member is operated; and a linking mechanism disposed between, and interconnecting, said platform and said ribbon holding member, and enabling the ribbon holding member, when said platform is unlocked from said normal position thereof, to put said active portion of said inked ribbon out of a path taken by said type wheel when mounted or removed.

9. A printer including a platen and a printing head which are movable relative to each other along a printing line on which characters are to be printed, said printing head having thereon: an electric drive motor; a rotor shaft rotated by said electric drive motor; a daisy-shaped type wheel which is mounted on one end of, and mountable and removable axially of, said rotor shaft; and a print hammer striking a type element toward said platen selectively located at printing position on said type wheel, wherein the improvement comprises:

a supporting mechanism holding said printing head pivotally between a first position thereof at which said printing head is permitted to perform a printing operation, and a second position thereof at which said printing head is mountable and removable;

biasing means for urging said printing head toward said second position thereof;

a locking mechanism disposed between said supporting mechanism and said printing head, and locking the printing head at said first position thereof against a biasing force of said biasing means;

a manual unlocking member connected to said locking mechanism, unlocking said printing head from said first position, and permitting the printing head to pivot to said second position;

a ribbon holding mechanism supporting and guiding an active portion of an inked ribbon between said selectively located type element and said platen;

a member fixed to said printing head; and a linking mechanism disposed between, and interconnecting, said fixed member and said ribbon holding member, and enabling the ribbon holding member, when said printing head is located at said second position thereof, to put said active portion of said inked ribbon out of a path taken by said type wheel when mounted or removed.

10. A printer including a platen and a printing head which are movable relative to each other along a printing line on which characters are to be printed, said printing head having: an electric drive motor; a rotor shaft rotated by said electric drive motor; a daisy-shaped type wheel which is mounted on one end of, and mountable and removable axially of, said rotor shaft; and a print hammer for striking toward said platen a type element selectively located at a printing position on said type wheel, wherein the improvement comprises:

printing head supporting means for supporting said printing head pivotally between a first position thereof at which said printing head is permitted to perform a printing operation, and a second position thereof at which said type wheel is mountable and removable, said printing head supporting means comprising a printer frame;

a manual member;

printing head pivoting means for pivoting said printing head from said first position to said second position in response to operation of said manual member;

ribbon holding means for supporting and guiding an active portion of a inked ribbon between said selectively located type element and said platen, said ribbon holding means comprising a pair of vibrators each pivotally supported at one end thereof by said printing head, the other ends of said vibrators having ribbon holders fixed thereto; and ribbon lifting means for moving said ribbon holding means, in response to the operation of said manual member, to put said active portion of said inked ribbon out of a path taken by said type wheel when mounted or removed, said ribbon lifting means comprising an arm extending from each of said vibrators in an opposite direction to the ribbon holders, and a fixed member disposed on said printer frame and engageable with said arm to prevent the same from pivoting together with said printing head, when said printing head is pivoted toward said second position, whereby said vibrators are pivoted relative to said printing head in the same direction as said printing head.

11. A printer including a platen and a printing head which are movable relative to each other along a printing line on which characters are to be printed, said printing head having: an electric drive motor; a rotor shaft rotated by said electric drive motor; a daisy-shaped type wheel which is mounted on one end of, and mountable and removable axially of, said rotor shaft; and a print hammer for striking toward said platen a type element selectively located at a printing position on said type wheel, wherein the improvement comprises:

printing head supporting means for supporting said printing head pivotally between a first position thereof at which said printing head is permitted to perform a printing operation, and a second position thereof at which said type wheel is mountable and removable;

a manual member;

printing head pivoting means for pivoting said printing head from said first position to said second position in response to operation of said manual member;

ribbon holding means for supporting and guiding an active portion of an inked ribbon between said selectively located type element and said platen;

ribbon lifting means for moving said ribbon holding means, in response to the operation of said manual member, to put said active portion of said inked ribbon out of a path taken by said type wheel when mounted or removed; and said ribbon lifting means comprising a platform attached to said printing head and being pivotable in the same direction as said printing head for supporting a cartridge which accommodates said inked ribbon, means for pivoting said platform relative to said printing head in response to the operation of said manual member, and a lift member fixed to said platform and engageable with said ribbon holding means to lift said ribbon holding means when said platform is pivoted relative to said printing head.

12. A printer as claimed in claim 11, wherein said platform pivoting means comprises:

platform biasing means for biasing said platform to pivot the platform relative to said printing head; and a latching lever pivotally attached to said printing head, and provided with a hooked portion engageable with said platform to hold the platform at a normal position thereof against a biasing force to said platform biasing means, said latching lever being further provided with a portion which engages said manual member to disengage said hooked portion from said platform when said manual member is operated.

13. A printing apparatus including a print head and a platen which are movable relative to each other along a printing line, said print head including a rotary disk print wheel and a ribbon cartridge forming an assembly having a ribbon movable along said printing line parallel to said platen and spaced therefrom in an operating position with said ribbon interposed between said rotary disk print wheel and said platen for printing, support means for said print head and ribbon cartridge assembly and for said platen, said print head and ribbon cartridge assembly comprising base means mounted on said support means, print head mounting means having a print head pivot axis parallel to said printing line pivotally mounting said print head on said base means for tilting of said print head into an inoperative position away from said platen, ribbon cartridge mounting means having a ribbon cartridge pivot axis parallel to and spaced from said print head mounting means, said ribbon cartridge pivot axis pivotally mounting said ribbon cartridge on said print head for tilting movement relative to said print head into an extended inoperative tilted position, and actuating means including disengageable latch means and biasing means for tilting said ribbon cartridge relative to said print head into said extended inoperative tilted position upon tilting of said print head into its inoperative position, whereby said print head and ribbon cartridge assembly provides for tilting movement of said print head and ribbon cartridge into said inoperative position tilted away from said platen with said ribbon cartridge in said extended inoperative tilted position spaced away from said print head for removal of said rotary disk print wheel free from interference from said platen or said ribbon cartridge without removing said ribbon cartridge.

* * * * *